United States Patent [19]

DeLooper

[11] Patent Number: 4,777,679

[45] Date of Patent: Oct. 18, 1988

[54] INFLATABLE CUSHION WITH CENTRAL OPENING

[76] Inventor: Pauline DeLooper, Avenue General Medecin, Derache 46, 1050 Brussels, Belgium

[21] Appl. No.: 4,439

[22] PCT Filed: Apr. 8, 1986

[86] PCT No.: PCT/BE86/00011

§ 371 Date: Dec. 15, 1986

§ 102(e) Date: Dec. 15, 1986

[87] PCT Pub. No.: WO86/05973

PCT Pub. Date: Oct. 23, 1986

[30] Foreign Application Priority Data

| | | | |
|---|---|---|---|
| Apr. 15, 1985 | [BE] | Belgium | 902197 |
| Jul. 18, 1985 | [BE] | Belgium | 902927 |
| Apr. 2, 1986 | [BE] | Belgium | 904530 |

[51] Int. Cl.[4] ..... A61G 7/04; A47C 27/10

[52] U.S. Cl. ..... 5/453; 5/455

[58] Field of Search ..... 5/453, 455, 456, 469, 5/441

[56] References Cited

U.S. PATENT DOCUMENTS

| | | | |
|---|---|---|---|
| 3,297,023 | 1/1967 | Foley | 5/457 |
| 3,681,797 | 8/1972 | Messner | 5/469 |
| 4,206,524 | 6/1980 | Cook | 5/469 |
| 4,225,984 | 10/1980 | Corbett et al. | 5/453 |
| 4,267,611 | 5/1981 | Agulnick | 5/453 |

*Primary Examiner*—Alexander Grosz

*Attorney, Agent, or Firm*—Balogh, Osann, Kramer, Dvorak, Genova & Traub

[57] ABSTRACT

Bedding or seat device featuring a first cushion which includes the following, a device of insuring a localized compression - decompression of the tissues around the bed sores, a device to avoid all contact with the bedsore itself, and a device to insure a continued ventilation of the bed sore, the first cushion being combined and placed on top of a second cushion either identical or different.

2 Claims, 10 Drawing Sheets

FIG. 7
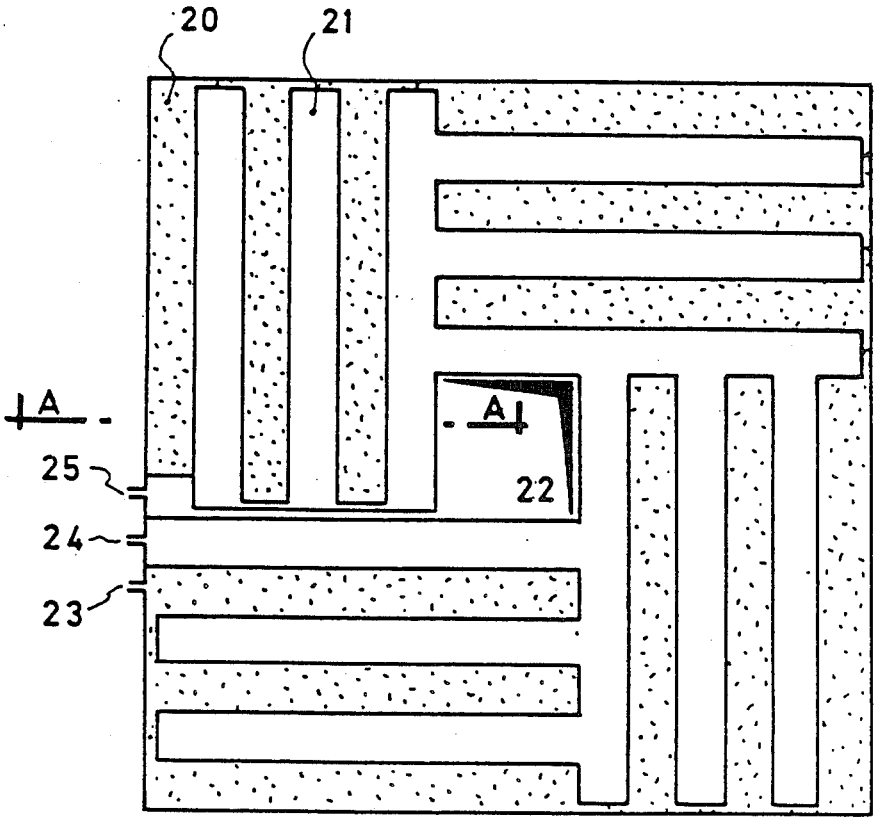
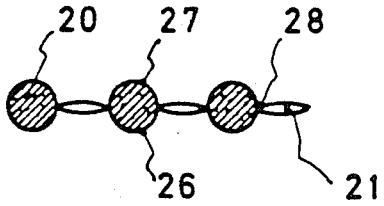
FIG. 8

INFLATABLE CUSHION WITH CENTRAL OPENING

The present invention relates to a body support device, in the form of a cushion to cure or prevent bedsores on body parts of bedridden patients.

This invention aims at eliminating the inconveniences inherent in rubber or foam rubber cushions. This is accomplished principally in three ways: it alternates compression and decompression in tissues around a bedsore; it avoids compression of the bedsore itself; and it brings air in contact with the bedsore.

To this end, this body support device comprises three elements: a means of inducing the compression and decompression which acts as a massage and prevents constant pressure on the tissues around the bedsore; a means of avoiding contact with and around the bedsore; and a means of conducting air to the bedsore.

Here follows a description of the invention with reference to the drawings:

FIGS. 2 and 3 are cross-section views of the cushion along lines A to A of FIG. 1 wherein;

FIG. 2 shows an inflation or compression phase and FIG. 3 shows a deflation or decompression phase;

FIG. 7 is a plan view of another prototype of a cushion made of two independent inflatable circuits, the open-space or opening in the cushion being provided with an air-intake;

FIG. 8 is a partial cross-section view along lines A—A of the cushion shown in FIG. 7;

In these various drawings, the same reference numbers indicate the same parts, unless otherwise indicated.

Figure 1:
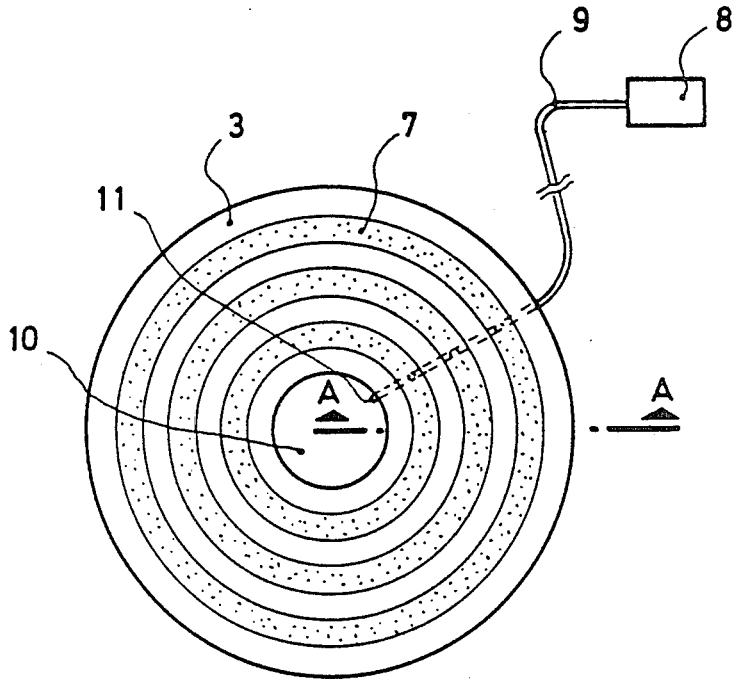
FIG. 1 shows a plan view of the first prototype of the body support cushion.
Figure 2:
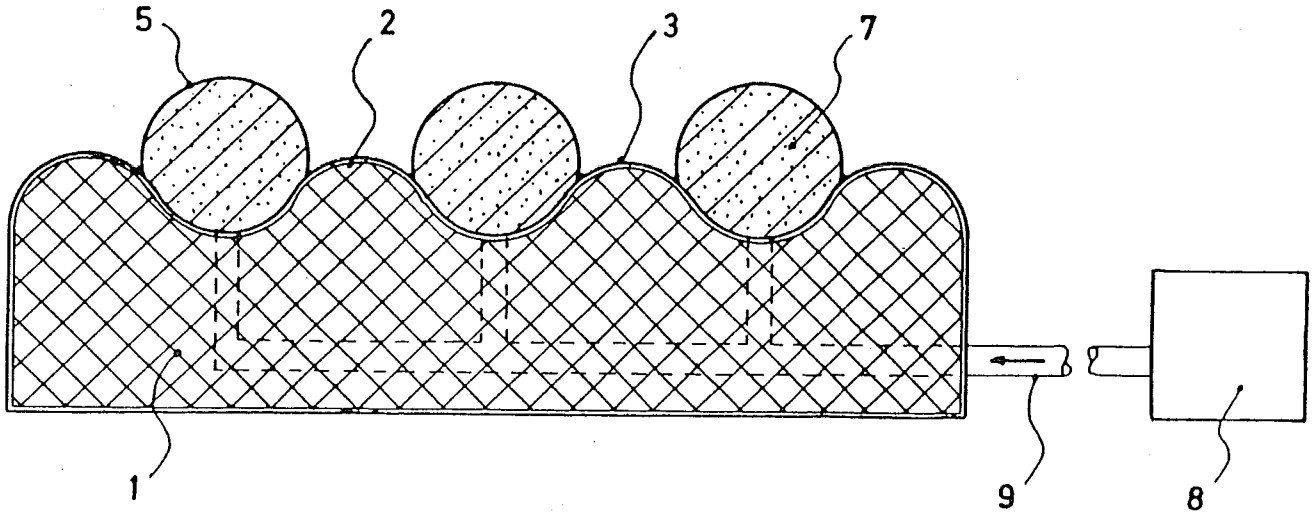
Figure 3:
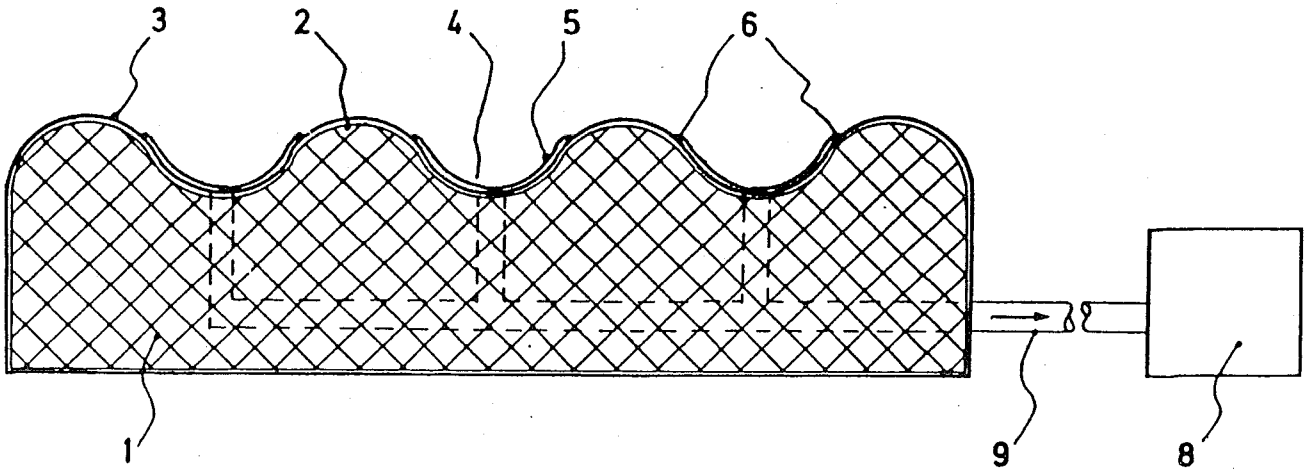

The cushion shown on FIGS. 1–3 includes a fixed base 1 of polyurethene foam. This fixed base has an undulating surface 2 covered by a thin sheet of polyethelene 3. The undulations are concentric and continuous.

Bottoms of hollows 4 have a second sheet of polyethylene 5 which is attached to the first sheet 3 along its edges 6 only, so that when the cushion is inflated the sheet 5 takes the shape of air filled tubes 7.

Air is forced into the tubes by a pump 8 through a duct 9 which traverses the polyurethene base 1.

The pump 8 alternately forces the air in and out, thus bringing about inflation and deflation of the tubes 7.

In the middle of the cushion, there is an open space 10 which is fed by an air intake 11. An opening of this air intake is small enough not to bring about a loss of pressure in the tubes 7 while they are being filled with air. The air intake 11 has a valve (not shown) which closes when the pump starts to draw the air out of the tubes 7. This valve opens when the pump starts to force air into the tubes 7 and stays open when the tubes 7 are more or less inflaged.

Figure 4A:
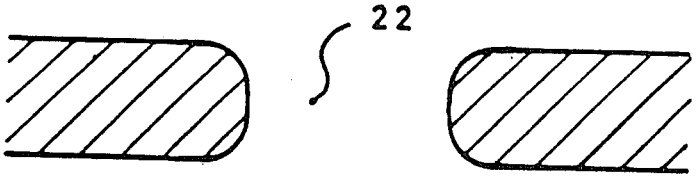
FIGS. 4A–4E show partial cross-sections of cushions provided with central open-space or opening.
Figure 4B:
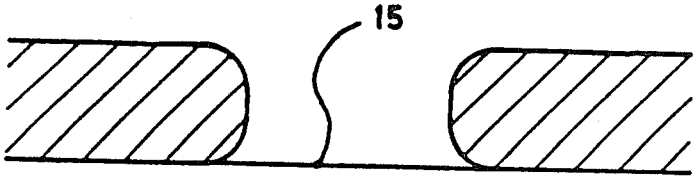
Figure 4C:
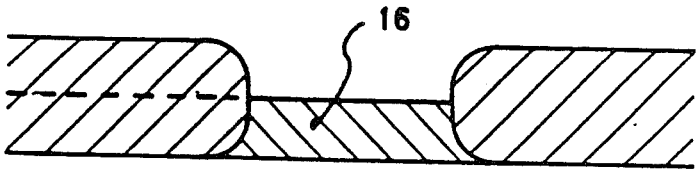
Figure 4D:
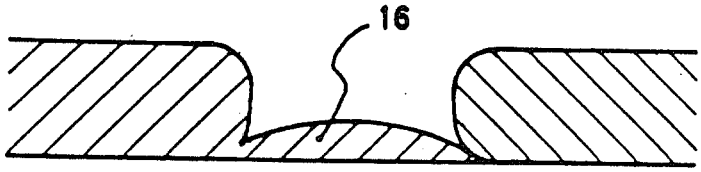
Figure 4E:
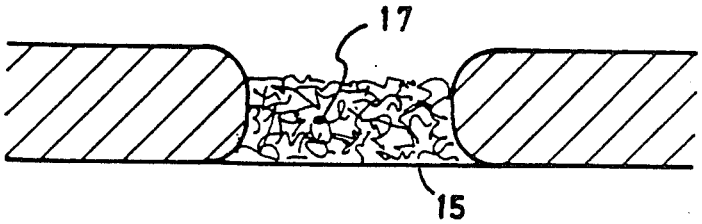

FIGS. 4A to 4E show partial cross section diagrams of several ways to form the open space or opening: opening extending through the cushion (FIG. 4A); closed at the bottom, by a sheet 15 (FIG. 4B) or by a layer of material 16 (FIGS. 4C–4E).

In FIGS. 4C and 4D, the thickness of the bottom layer is obtained by inflation or by filling it with a different material.

The bottom closing of the open space or opening may or may not be an integral part of the rest of the cushion.

FIG. 4E gives an example of the open-space or opening which is closed at the bottom by a sheet 15 and the opening has been filled with an absorbing material 17 such as cotton, gauze, or foam, or with a medicated substance. The open space or opening may be round, square, rectangular, polygonal, oval-like or other form.

As described above, FIGS. 1 through 3 show an arrangement which provides localized compression and decompression of the tissues; which is made up of an undulating foam-base covered by a flexible sheet which is fused to it at crests of its undulations. The sheet and the undulating foam-base thus attached to each other form inflatable tubes which are constituted by the hollows of the undulations and the sheet. Depending on whether the tubes are inflated or deflated, the upper portion of the tubes (at inflation) or the crests of the wavy foam-base (at deflation) come in contact with the tissues around the bedsore in different places by alternating compression and decompression.

Figure 5A:
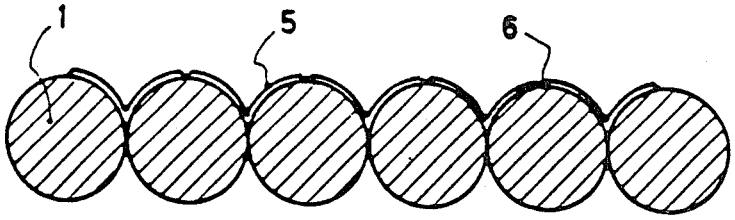
FIGS. 5A–5B show partial sectional views of cushions made up of two layers, of which the upper layer can be alternately inflated and deflated, The FIG. 5A showing deflation and FIG. 5B showing inflation.
Figure 5B:
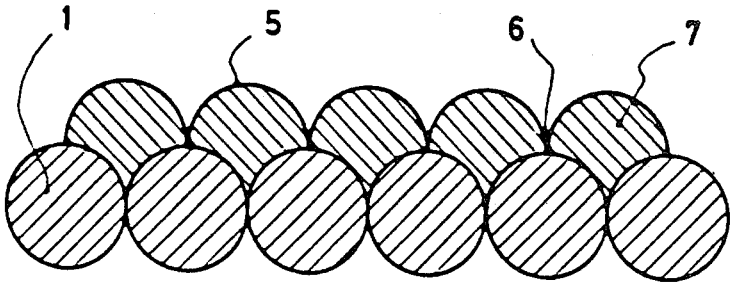

FIGS. 5A and 5B show an alternative plan for the above mentioned arrangement: the foam-base is replaced by a cushion 1 made up of permanently inflated tubes which form a series of crests 6. A sheet 5 is fused to the cushion at its crests, thus forming a series of deflated tubes 7. These tubes are shown deflated in FIG. 5A and inflated in FIG. 5B.

Figure 6A:
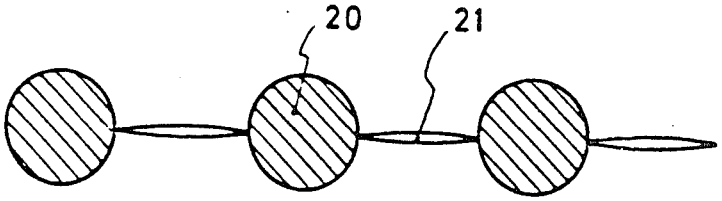
FIGS. 6A–6B are partial cross-section views of one layer made up of two independent circuits of tubes running alongside each other and being alternately inflated-deflated, the FIG. 6A shows one of the circuits inflated and the FIG. 6B shows the other circuit inflated.
Figure 6B:
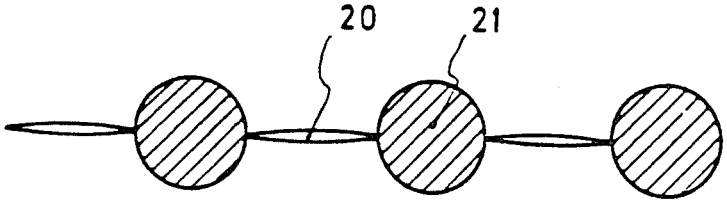

There could conceivably be two sets or circuits of tubes on a common plane, named respectively 20 and 21, which can be inflated and deflated each in turn, as shown in FIGS. 6A and 6B.

FIG. 7 shows how two inflatable circuits can be disposed around an open space or opening 22. Also shown are the two air intakes 23 and 24, one for each circuit. Air can also be brought to the open space or opening 22 by a duct 25.

As shown in FIG. 8 ( a partial cross-section view along lines A—A of FIG. 7), the circuits of tubes 20 and 21 and the air intake 25 may be constituted by superimposing and fusing two sheets designated 26 and 27 respectively. The reference number 28 designates the lines along which these sheets are fused.

Figure 9:
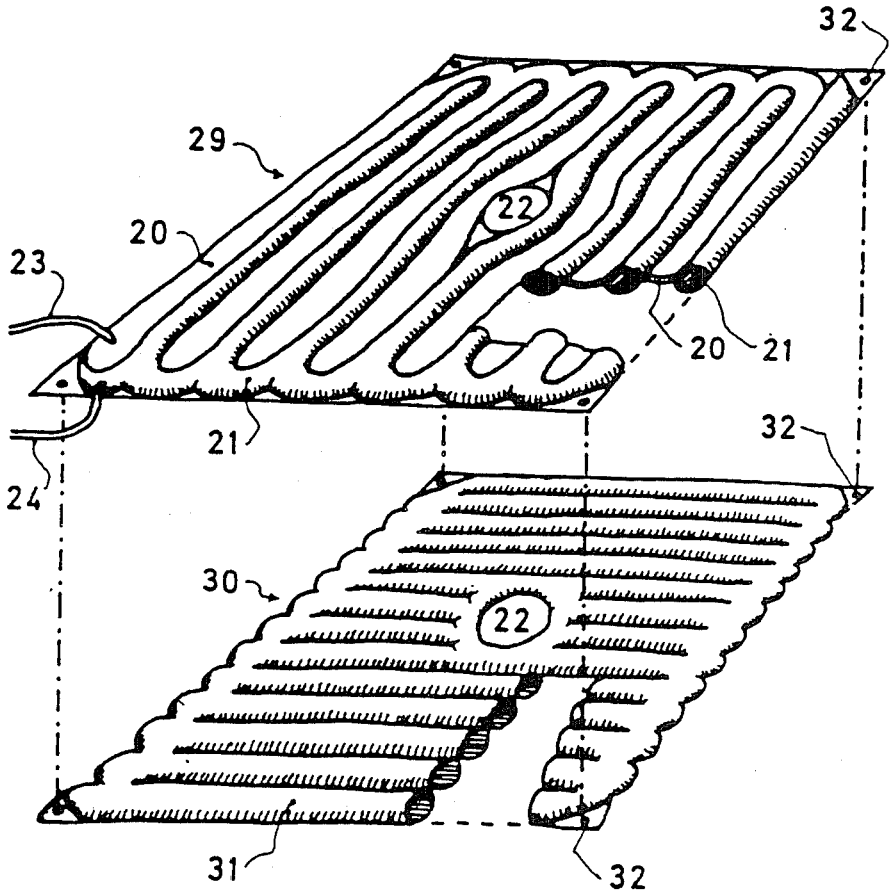
FIG. 9 is a perspective view of a further prototype of a two-layer cushion, wherein the upper layer is made up of two independent inflatable circuits of tubes and the lower layer forms a fixed base.

FIG. 9 is a perspective of two superimposed cushions 29 and 30. The upper cushion 29 is similar to the one shown in FIG. 7. It is made up of two combined tube circuits 20 and 21 that can be alternately inflated and deflated. Each of these tubes circuits comprises an air-intake-outlet, respectively 23 and 24. The bottom or supporting cushion 30, however, has only one tube-circuit 31 and stays permanently inflated. Each cushion has an open space or opening 22. The cushions can be fastened to each other by clips 32. A duct to let air into the open space or opening 22 can be inserted between the two cushions. The bottom cushion does not necessarily require an open space or opening.

Instead of superimposing two cushions having different tube circuits it is possible to superimpose two identical cushions of the type of the upper cushion 29. In both cases the bottom or supporting cushion provides a sufficient thickness which cannot be obtained with a single cushion.

Figure 10:
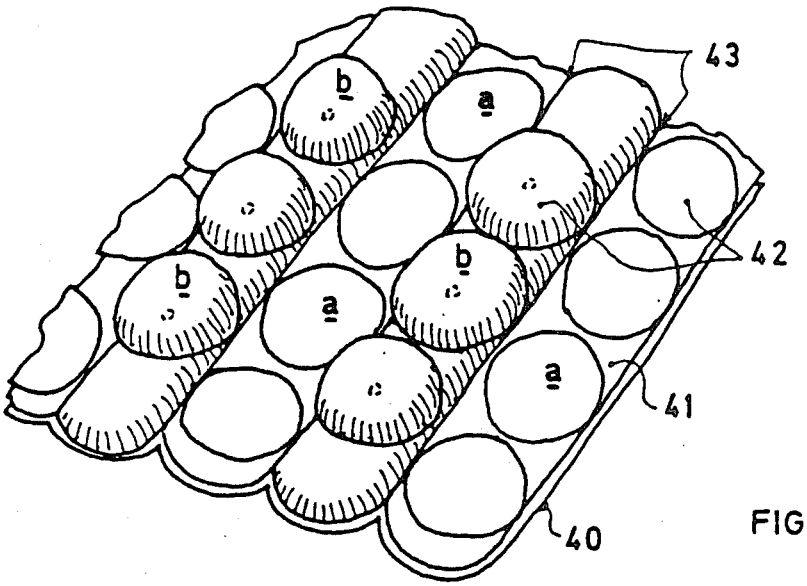
FIGS. 10 and 11 show two types of cushions, honeycombed with air-pockets.

The tubes circuits may be modified in such a way as to constitute a network of air-pockets, FIG. 10 showing an honeycomb pattern.

Figure 10A:
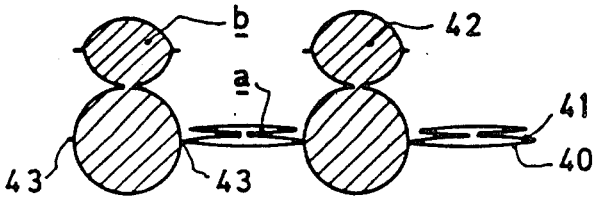
FIGS. 10A–10C and 11A–11C diagram three phases of inflation-deflation of these air-pockets cushions.
Figure 10B:
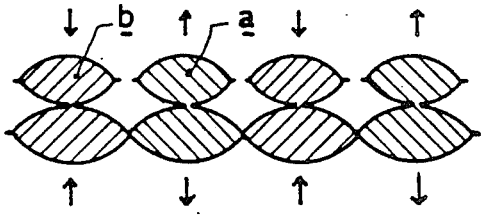
Figure 10C:
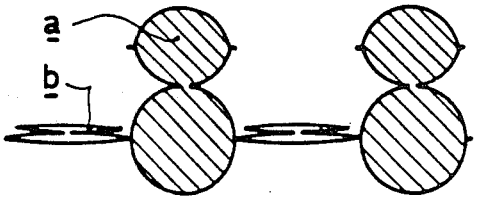

An honeycomb pattern can be achieved with two sheets 40 and 41, sheet 41 having been shaped to possess a honeycomb pattern with air-pockets 42. These two sheets are then fastened to one another by fusing along seams 43 so as to delineate the limits of two independent circuits a and b which will be alternately inflated and deflated. FIGS. 10A to 10C show the various phases of inflation-deflation. From the initial phase shown in FIG. 10A (circuit a is deflated and circuit b is inflated), one moves to an intermediary phase shown in FIG. 10B (circuit a is being inflated and circuit b is being deflated) to arrive at the last phase shown in FIG. 10C (circuit a is completely inflated and circuit b is completely deflated). This process is then reversed.

Figure 11:
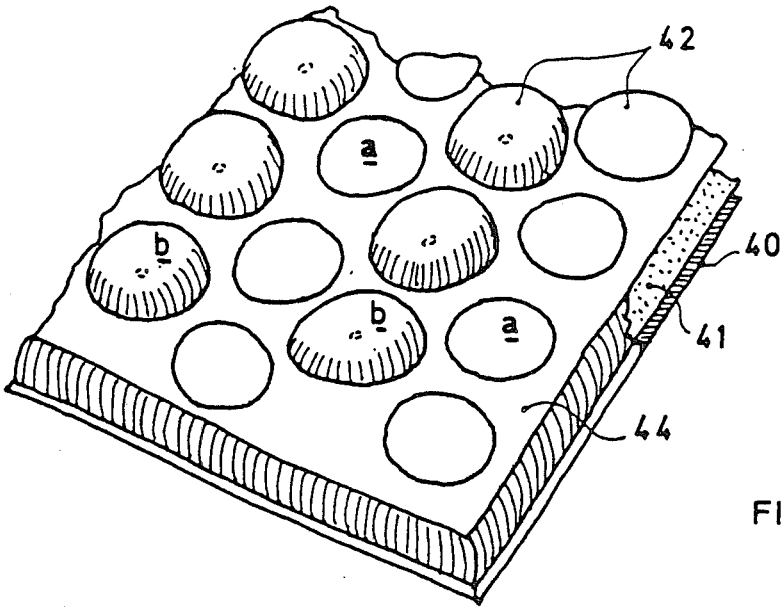
Figure 11A:
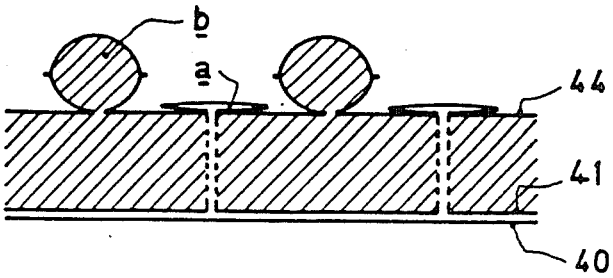
Figure 11B:
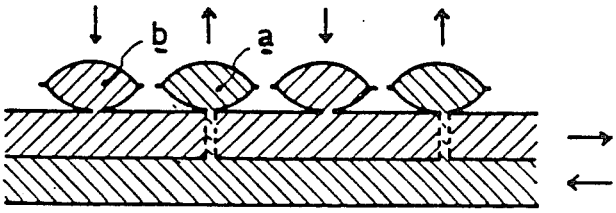
Figure 11C:
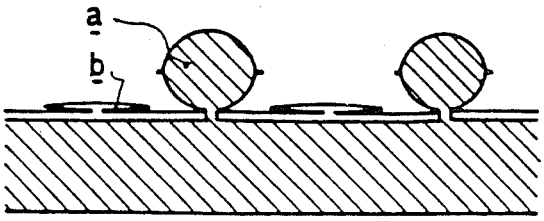

Another combination of circuits with air-pockets is shown in FIG. 11 and is achieved by using three sheets 40, 41 and 44. As it is shown in FIGS. 11A to 11C, sheets 40 and 41 form a first circuit a whereas sheets 41 and 44 form a second circuit b. The top portion of each of these circuits has a series of air-pockets 42. FIGS. 11A–11C illustrate the inflation-deflation mode which is similar to the mode shown in FIG. 10A to 10C.

It is also possible to devise a device having more than three sheets. For example, to superimpose 4 sheets and arrange them into various combinations of permanently inflated circuits and alternately inflated-deflated circuits.

Figure 12A:
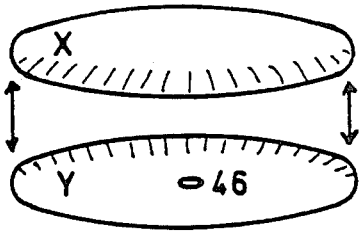
FIG. 12A shows, on a large scale, two halves of an air pocket before it is assembled and FIG. 12B diagrams the installation of an air-pocket on an inflatable circuit.
Figure 12B:
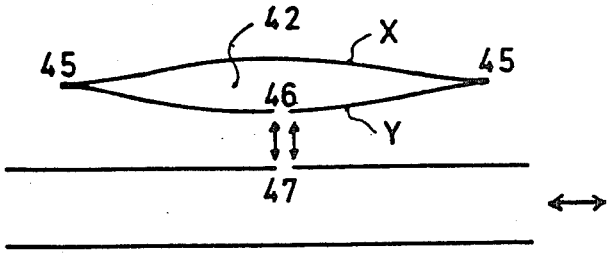

An interesting way of constituting the air-pockets is pictured in FIGS. 12A and 12B. In FIG. 12A, one half of a cell x is fastened by fusing its edges 45 onto those of another half-cell y which has a central hole 46. In FIG. 12B the circumference of hole 46 is fastened by fusing onto the circumference of a corresponding hole 47 in the inflation-deflation circuit.

Figure 13:
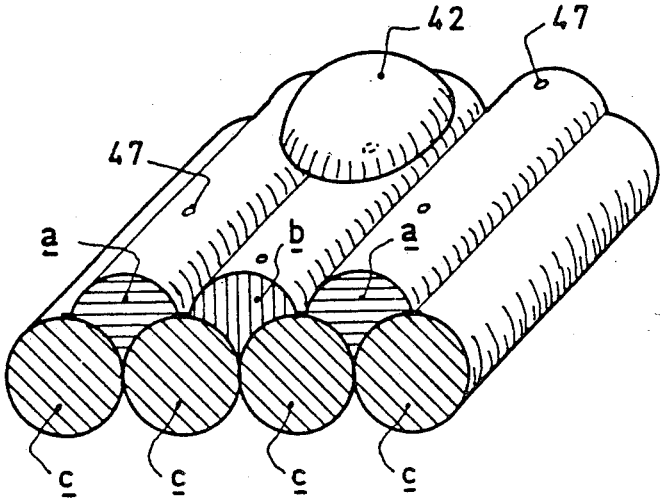
FIG. 13 is a diagram in partial perspective of a portion of still another type of an air-pocket cushion.

FIG. 13 shows a partial perspective of another variation of an honeycombed cushion. It shows a combination of a permanently inflated circuit c and alternately inflated-deflated circuits a and b. An air-pocket 42 is fastened by fusing with each hole 47 of circuit a and of circuit b; these air-pockets are thus inflated and deflated at the same time as the corresponding circuit. The air-pockets are staggered from circuit to circuit.

Air can be fed to the open space of opening 22 by means of ducts at the site of the bedsore, see duct 9 shown in FIG. 1. In the case of a multilayered unit, the air ducts may be run through a layer, if the latter is made, as shown in FIG. 2, of foam. Of the ducts may pass between two sheets as shown in FIG. 8. Valves may be introduced at the beginning or at the end of the air-ducts or they may be left out. Or other similar modifications may be made.

In this way, the cushion provides all the advantages of the known systems while avoiding their drawbacks. Thanks to the system of tubes with their compression-decompression effect, the inconvenience of a rubber or foam ring is avoided. There is no constant pressure on the tissues around the bedsore to hinder normal blood circulation and healing. On the other hand the advantages of the ring are obtained with the open space or opening 10 in the middle of the cushion. Furthermore, this invention provides the advantages of mattresses which work with alternating compression and decompression, while at the same time avoiding the inconveniences of these mattresses, i.e. continuous contact with the bedsore, repeated pressure on the bedsore and the absence of aeration of the bedsore. In this invention, the air brought into the open space 10 in the middle of the cushion prevented maceration of the bedsore.

It is understood that the above details in no way limit or restrict this invention.

I claim:

1. A body support device comprising a first inflatable cushion, provided with substantially transversely extending tubes, a central opening in said first cushion, a second cushion placed on top of said first cushion; a central opening in said second cushion in alignment with said central opening in said first cushion, said second cushion having longitudinally extending means for applying localized compression-decompression to tissues around a bed sore of a patient supported on said device said localized compression-decompression means including at least in said upper cushion two circuits of substantially longitudinally extending tubes on the same plane, which can be alternately inflated and deflated, and means to connect the first cushion to the second cushion.

2. The device as claimed in claim 1, wherein said localized compression-decompression means further include means of inflating and deflating with a separate intake-outlet for each of the above mentioned circuits.

* * * * *